United States Patent [19]

Tran

[11] Patent Number: 5,052,104

[45] Date of Patent: Oct. 1, 1991

[54] METHOD FOR TERMINATING WIRES OF A CABLE EN MASSE

[75] Inventor: Nam D. Tran, Fort Worth, Tex.

[73] Assignee: Tandy Corporation, Fort Worth, Tex.

[21] Appl. No.: 580,983

[22] Filed: Sep. 12, 1990

Related U.S. Application Data

[62] Division of Ser. No. 429,438, Oct. 31, 1989, Pat. No. 4,974,331.

[51] Int. Cl.[5] ..... H01R 43/04

[52] U.S. Cl. ..... 29/861; 29/721

[58] Field of Search ..... 29/720, 721, 753, 755, 29/754, 593, 861

[56] References Cited

U.S. PATENT DOCUMENTS 4,711,025 12/1987 DeSanto ..... 29/854
4,727,637 3/1988 Buckwitz et al. ..... 29/721 X
4,951,385 8/1990 DeSanto ..... 29/754

*Primary Examiner*—Carl E. Hall
*Attorney, Agent, or Firm*—Townsend and Townsend

[57] ABSTRACT

A discrete wire discriminator for identifying each terminal position of a connector to be terminated to a multiconductor cable comprising a plurality of identical, unmarked, insulated conductors is described. The conductors of the first end of the cable are randomly terminated. After the second end of the cable is placed in the apparatus, each wire at the second end is selected at random and its correct terminal position identified by the apparatus, in addition, the selected wire is simultaneously tested for short or open circuits.

6 Claims, 6 Drawing Sheets

METHOD FOR TERMINATING WIRES OF A CABLE EN MASSE

This is a division of application Ser. No. 07/429,438 filed Oct. 31, 1989, now U.S. Pat. No. 4,974,331.

BACKGROUND OF THE INVENTION

The present invention is related generally to machines for mass terminating multi-conductor electrical cables used in electronic equipment, and more particularly, to an improved apparatus for discriminating individual wires of a cable to be terminated.

Conventional machines for mass terminating electronic cables do not include the capability for sorting individual wires to correctly match each wire with its respective terminal. Other operations, some of which employ special cable constructions to facilitate wire identification, must be used to sort and place the wires in the correct position to be terminated. In addition, any required continuity testing entails yet additional operations.

For example, some of the previous techniques for sorting wires utilized wires with color-coded insulation or other marking, or used flat cables with an inherent position reference to identify individual wires, or performed the termination prior to bundling the wires into cable form thus facilitating selection and matching to corresponding terminals of a connector. All of these methods required special construction or handling operations which add material and labor cost due to relatively low labor productivity. A further technique with cables formed of identically colored or marked wires is to perform individual continuity tests with each wire. This reduces material cost but adds significant labor and equipment costs. Low productivity due to the tediousness of the task and resulting fatigue also introduces additional cost and increases the burden on the quality assurance operations for the testing of completed cables.

SUMMARY OF THE INVENTION

Accordingly, the Discrete Wire Discriminator includes an arbor press for mass termination of a cable to a connector, which is equipped with a lower fixture and an upper fixture. According to an embodiment of the present invention, this arbor press is further equipped with a discriminator, an array of LED indicators and an ejector unit. A previously terminated first end of a cable wherein the identical, unmarked wires are randomly terminated to the connector on the first end, is connected to the ejector unit and the second end of the cable and a connector to be installed on the cable are placed in the lower fixture. A wire of the cable is randomly selected by the operator who touches the free end of the wire to a grounding post, thus causing the discriminator to illuminate an LED indicator adjacent to the correct terminal of the connector to which the wire will be terminated. The wire is then placed in a corresponding slot of the wire sorter to be retained in position immediately above the selected terminal until all the wires are sorted and retained above their respective terminals of the connector. Next, the lower fixture is moved rearward to a position directly below the upper fixture. Upon operation of the arbor press, the upper fixture moves downward so that the upper terminator and the upper shear blade contact the wires and terminals for the connector in the lower fixture, whereby the wires are simultaneously and respectively terminated and the excess length sheared. Following return of the upper fixture and the lower fixture to their quiescent positions, the terminated cable assembly is removed from the press. Continuity and short circuit testing of each wire has occurred simultaneously during the selection and discrimination of each wire.

Therefore, it is an object of the present invention to provide an improved mass termination apparatus for matching a multiconductor cable to the correct terminals of a connector with a single operation for each wire.

It is another object of the present invention to test the continuity of each wire as its assigned terminal is identified.

It is yet another object of the present invention to determine the location of short circuits between individual wires during the termination procedure.

It is yet another object of the present invention to minimize the number of hand operations necessary to mass terminate and test a multiconductor cable.

It is yet another object of the present invention to perform the final test procedure of the completed cable on the discrete wire discriminator as an additional step following the termination.

It is yet another object of the present invention to expand the variety of cable configurations that can be produced through the use of adapters to the discrete wire discriminator.

DETAILED DESCRIPTION OF THE INVENTION

Figure 1:
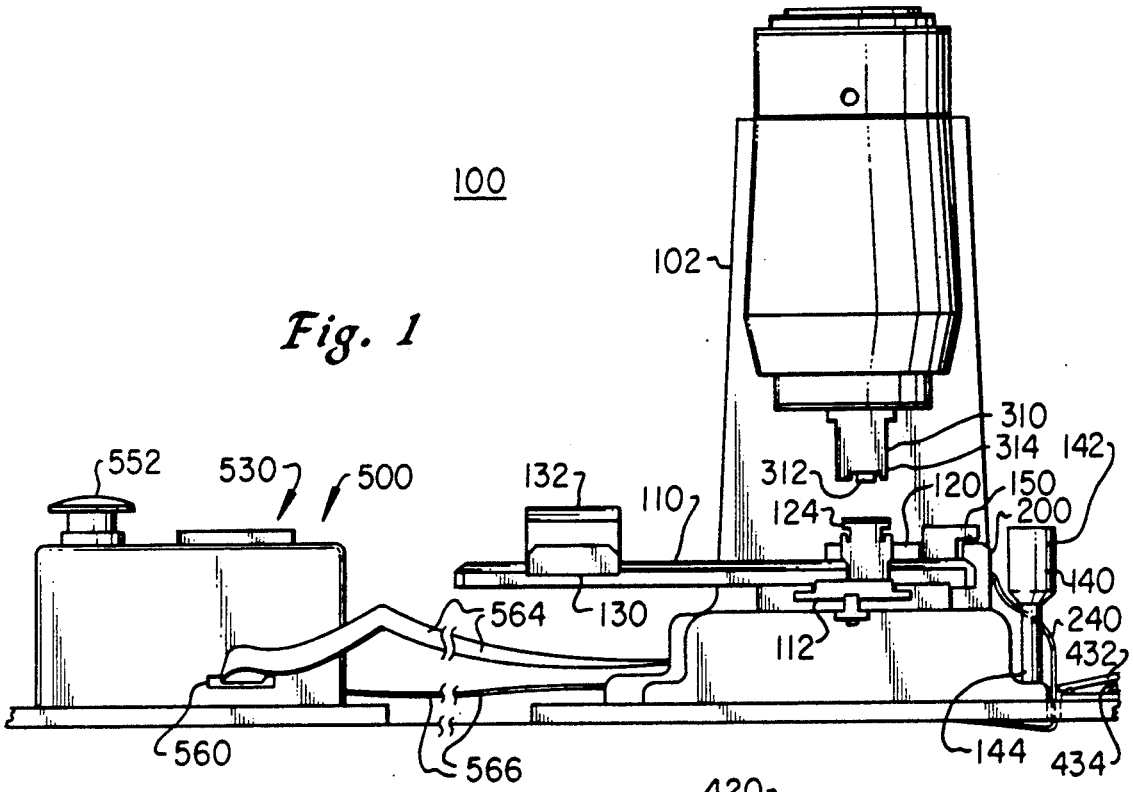
FIG. 1 is a front elevation view of a discrete wire discriminator embodying the present invention.
Figure 2:
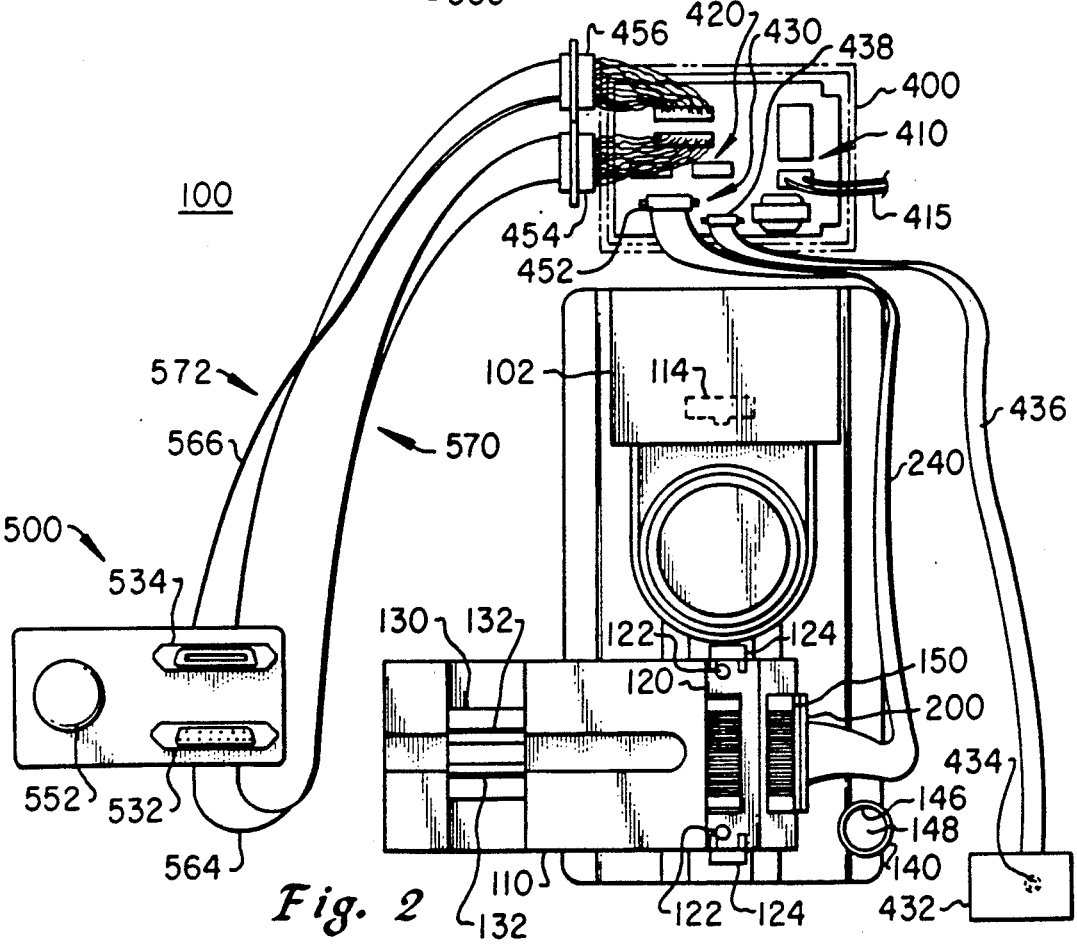
FIG. 2 is a top view of the discrete wire discriminator in FIG. 1.

A discrete wire discriminator constructed according to a preferred embodiment of the present invention is indicated generally by the reference numeral 100 in FIG. 1 and FIG. 2. A horizontally slidable lower fixture 110 and a movable upper fixture 310 are mounted to an arbor press 102 as shown in FIG. 1. An example of a suitable arbor press used in the preferred embodiment is type number 91112-3 "Pneumatic Arbor Press w/Auto Cycle" supplied by AMP Incorporated, Harrisburg, Pa. 17105. Attached to one end of the horizontally slidable lower fixture 110 is an assembly consisting of a wire sorter 150 and an array of indicating elements 200, also shown in FIGS. 1 and 2. Shown to the left of arbor press 102 in FIGS. 1 and 2 is an ejector unit 500. Connected between ejector unit 500 with an ejector cable 564 and the array of indicating elements 200 with a discriminator cable 240 is a discriminator 400 as illustrated in FIG. 2. Further shown in FIG. 2 is a reset activator 432 connected to the discriminator 400 by a reset cable 436.

LOWER FIXTURE

Figure 6:
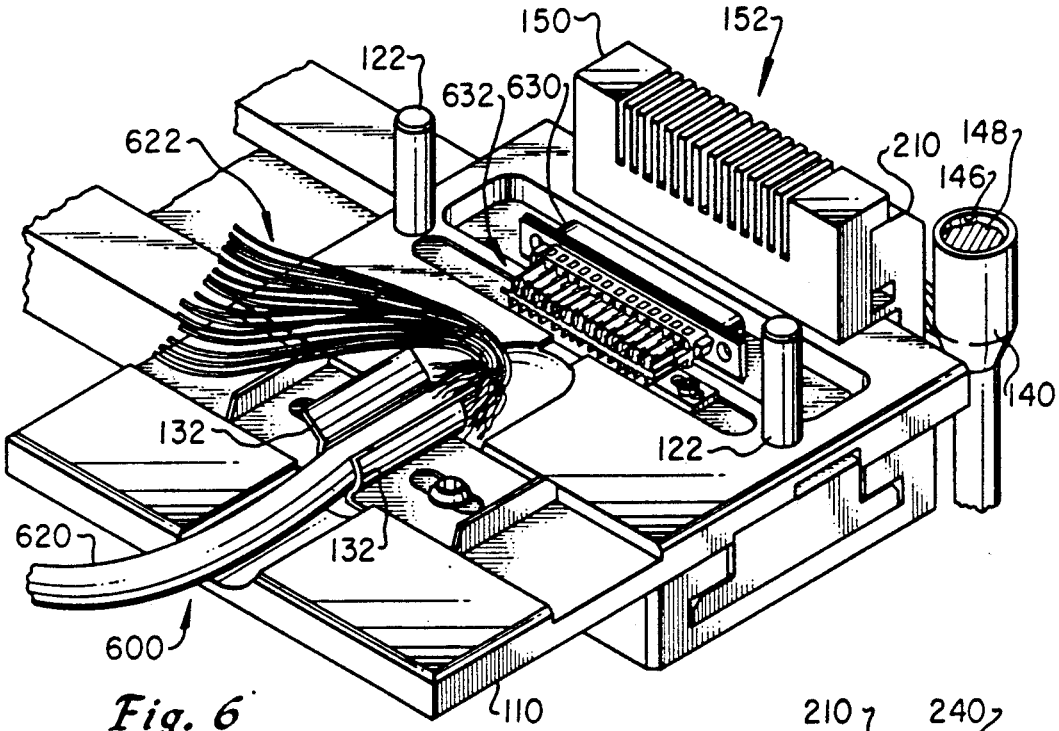
FIG. 6 is a detail perspective view of the lower fixture with the LED indicator and wire sorter assembly mounted thereon showing a cable inserted prior to performing the discriminating operations.

Referring to FIGS. 1 and 6, the horizontally slidable lower fixture 110 for supporting and locating the workpieces is mounted on and is configured to slide upon lower fixture rail 112 which is part of the arbor press 102. The workpieces consist of a cable 600 to be terminated to a connector 630 during the discrimination and termination procedure to be described later. Then as shown in FIG. 1, mounted upon the horizontally slidable lower fixture 110, hereinafter called "lower fixture 110", are a connector retainer 120 and a cable retainer 130 in addition to the previously mentioned wire sorter 150 and array of indicating elements 200. A grounding post 140 is also attached to arbor press 102 adjacent to the right-hand end of the indicator assembly 200 when the lower fixture 110 is in its quiescent position as shown in FIG. 2.

Figure 7:
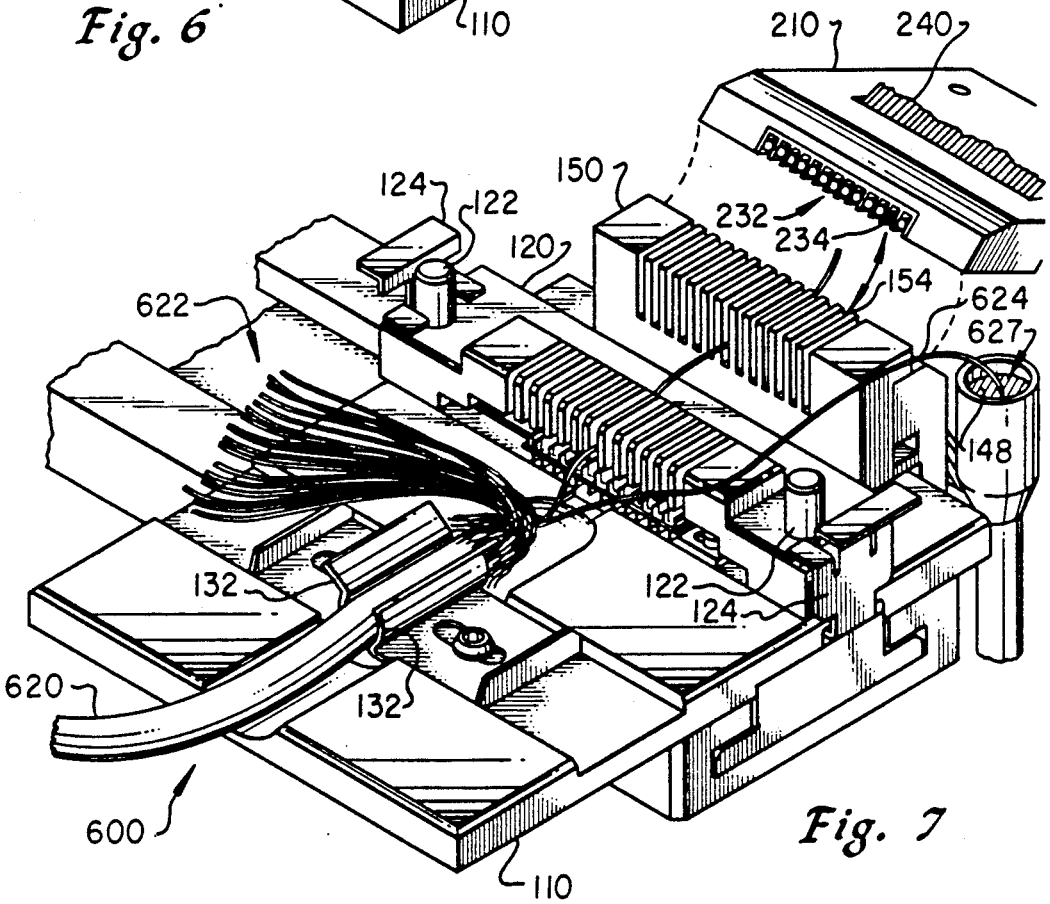
FIG. 7 is a similar perspective view of FIG. 6 during operation of the discriminator which includes a detail top view perspective showing the illumination of an indicator corresponding to the selected wire.
Figure 8:
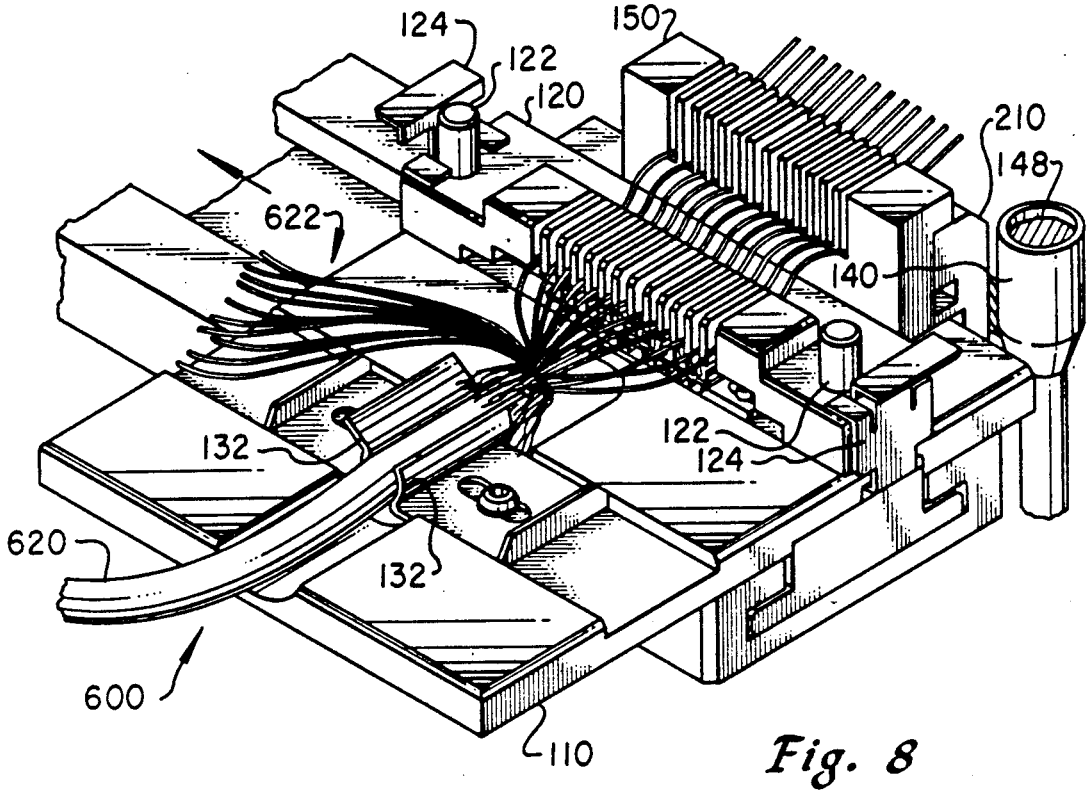
FIG. 8 is a similar perspective view of FIG. 7 after all wires discriminated and prior to termination.

The connector retainer 120 shown in FIG. 1 and 2 and also in FIG. 7 and 8 locates and secures the connector 630 to be terminated in position upon the lower fixture 110. Connector retainer 120 is located on the lower fixture 110 by guide pins 122 and locked into position by spring clips 124. Connector retainer 120 is typical of interchangeable tooling used in mass termination equipment and since its manufacture is by means well known in the art it will not be described herein. Likewise, the cable retainer 130 for locating and securing the cable 600 to be terminated, comprised of a pair of resilient elements 132 adjustably mounted upon lower fixture 110 in opposition, as also shown in FIGS. 6 through 9, are well known in the art and will thus not be described in further detail herein.

As shown in FIG. 2, the previously mentioned grounding post 140 is electrically connected at its lower end 144 to the discriminator power supply common terminal to be described later, and is fabricated from a conductive material such as brass with a well 146 bored in the upper end 142 for containing a conductive fluid 148. The purpose of the grounding post 140 is to supply an input signal to the discriminator 400 from each of the plurality of wires 622 during the discrimination operation.

INDICATOR ASSEMBLY

Figure 3:
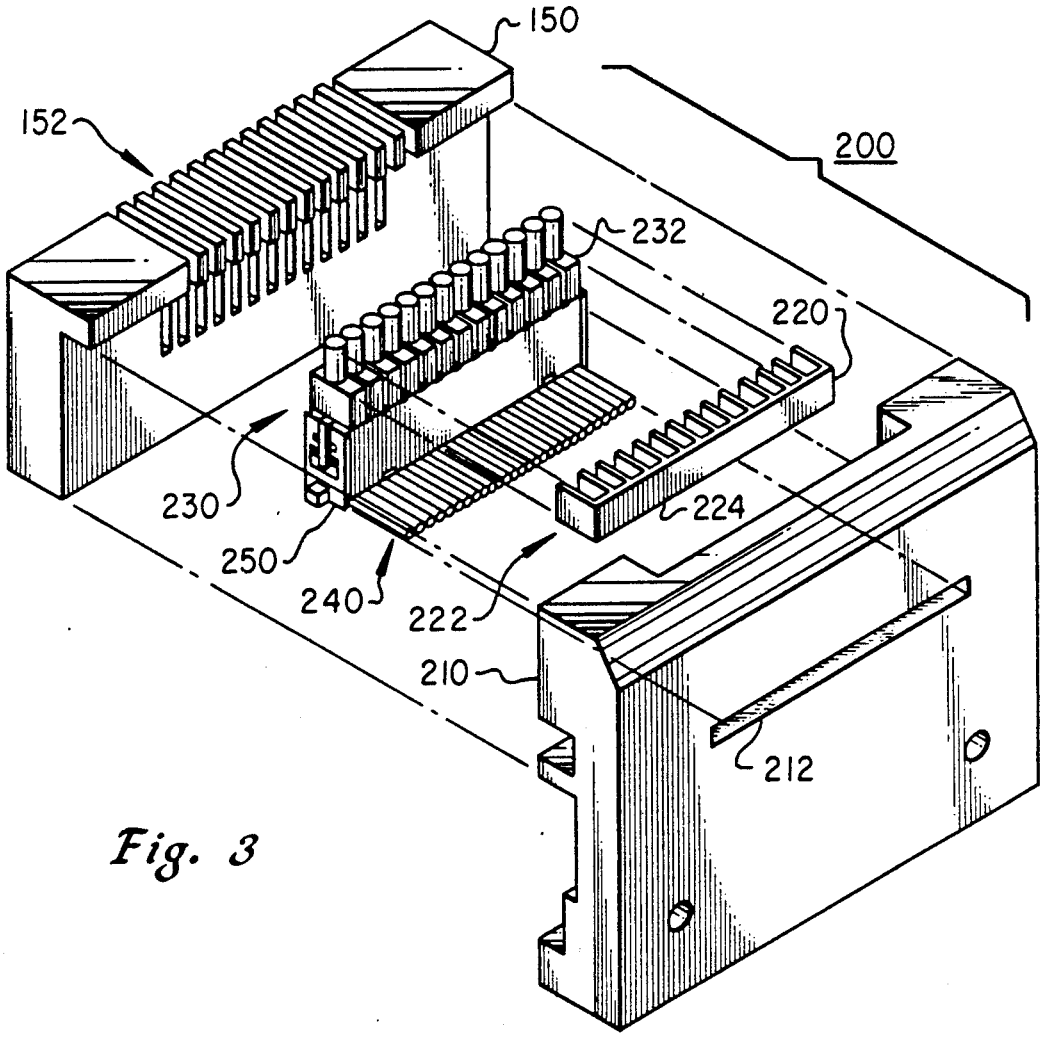
FIG. 3 is an exploded perspective view of the LED indicator and wire sorter assembly.
Figure 10:
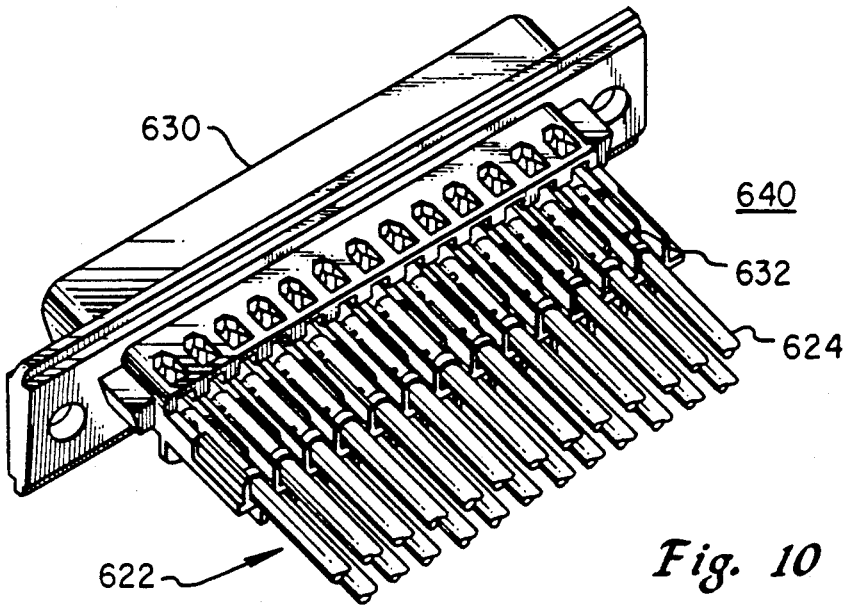
FIG. 10 is a perspective view of a typical mass terminated connector that has been installed on a cable with the discrete wire discriminator.

Referring to FIG. 3, the array of indicator elements 200, hereinafter called "indicator assembly 200", includes a holder 210, a guide spacer 220, a plurality of light emitting diodes 232 inserted into the receptacles 252 of an illuminator connector 250 and a flat, flexible discriminator cable 240. The guide spacer 220, a one-piece element fabricated from a connector body and comprised of insulated spacers 222 connected at uniform intervals to a strip of like insulating material 224, fits against and aligns the upper, rounded portion of each light emitting diode 232 with the centerline of the respective receptacles 252. The light emitting diode 232 used in the preferred embodiment is a type LN222 RP supplied by Matsushita Electric under the brand name Panasonic. Any LED equivalent in physical configuration and performance may be used. The flexible discriminator cable 240 passes through the opening 212 in holder 210 and interconnects the receptacles 252 to the previously mentioned discriminator 400.

Again referring to FIG. 3, wire sorter 150 with uniformly-spaced, parallel slots 152 corresponding to the terminal spacing of the connector 630 to be terminated (see FIG. 6) is secured to the right-hand end of lower fixture 110 using machine screws or similar means well known in the art. Holder 210, with the illuminator connector 250, for example a type 609-2630 supplied by T & B/Ansley Corporation, configured with light emitting diodes 232 and the discriminator cable 240 drawn against holder 210, is placed against wire sorter 150, thereby clamping the connector 250 configured with the row of light emitting diodes 232 and cable 240 between the holder 210 and wire sorter 150. Holder 210 is then secured to the right-hand end of the lower fixture 110 using machine screws or similar means well known in the art, so that each light emitting diode 232 is positioned directly below a corresponding parallel slot 152 in the wire sorter 150. Thus, upon illumination, each light emitting diode 232 is clearly visible from above the wire sorter 150.

Wire sorter 150 and holder 210 are machined from solid PVC (polyvinyl chloride) material. The parallel slots 152 in wire sorter 150 are configured for each wire gauge such that the width of each slot is slightly smaller than the diameter of the insulated wire. A wire is retained in the slot during the termination operation by the resulting compressive force exerted by the resilient insulation upon the walls of the parallel slot 152.

UPPER FIXTURE

FIG. 1 shows a movable upper fixture 310 comprised of an upper shear blade 314 for evenly trimming the excess length from each selected one of the plurality of wires 622 and an upper terminator 312 to effect the insulation displacement termination operation thereby. The insulation displacement termination operation occurs when the movable upper fixture 310 moves downward when activated by the trip switch 114 located at the rear of the lower fixture rail 112 (see FIG. 1), which is tripped by the rearward sliding lower fixture 110, until it meshes with the plurality of wires 622 and connector terminals 632, thereby afixing the connector terminals 632 to each of the plurality of wires 622.

DISCRIMINATOR

The discriminator 400 shown in FIG. 2 converts a signal obtained by touching a randomly selected one of the plurality of wires 622 to the grounding post 140 into an output signal for illuminating a corresponding light emitting diode 232 in the indicator assembly 200 according to a schedule predetermined for each different type of cable 600 to be terminated using the present invention. The ground signal from the grounding post 140 is conveyed by the wire being selected through the ejection interface 500 via either ejector connector A, 532, or ejector connector B, 534, to the input of the discriminator 400 at discriminator connector A, 454, or discriminator connector B, 456, respectively, over the corresponding ejector cable A, 564, or ejector cable B, 566.

To simplify the discussion that follows, the above referenced connectors 532, 454 and cable 564 are hence referred to as channel A, 570 and channel B, 572 respectively. Two parallel discriminator input channels A and B are provided in the preferred embodiment although any number of channels could be provided to accomodate different connector/cable requirements. During the discussion that follows only channel A, 570, will be described since channel B, 572, functions identically, except the particular ejector connector 534 is different from the other ejector connector 532.

The other cables connected to the discriminator 400 are the previously described discriminator cable 240 used for conveying the discriminator output signals to actuate the light emitting diodes 232 and a reset cable 436 to signal the closure of the reset switch 434 to the discriminator 400. In addition, if battery power is not used to power logic circuit 420 and light emitting diodes 232, an AC input cable 415 may be used.

Figure 11:
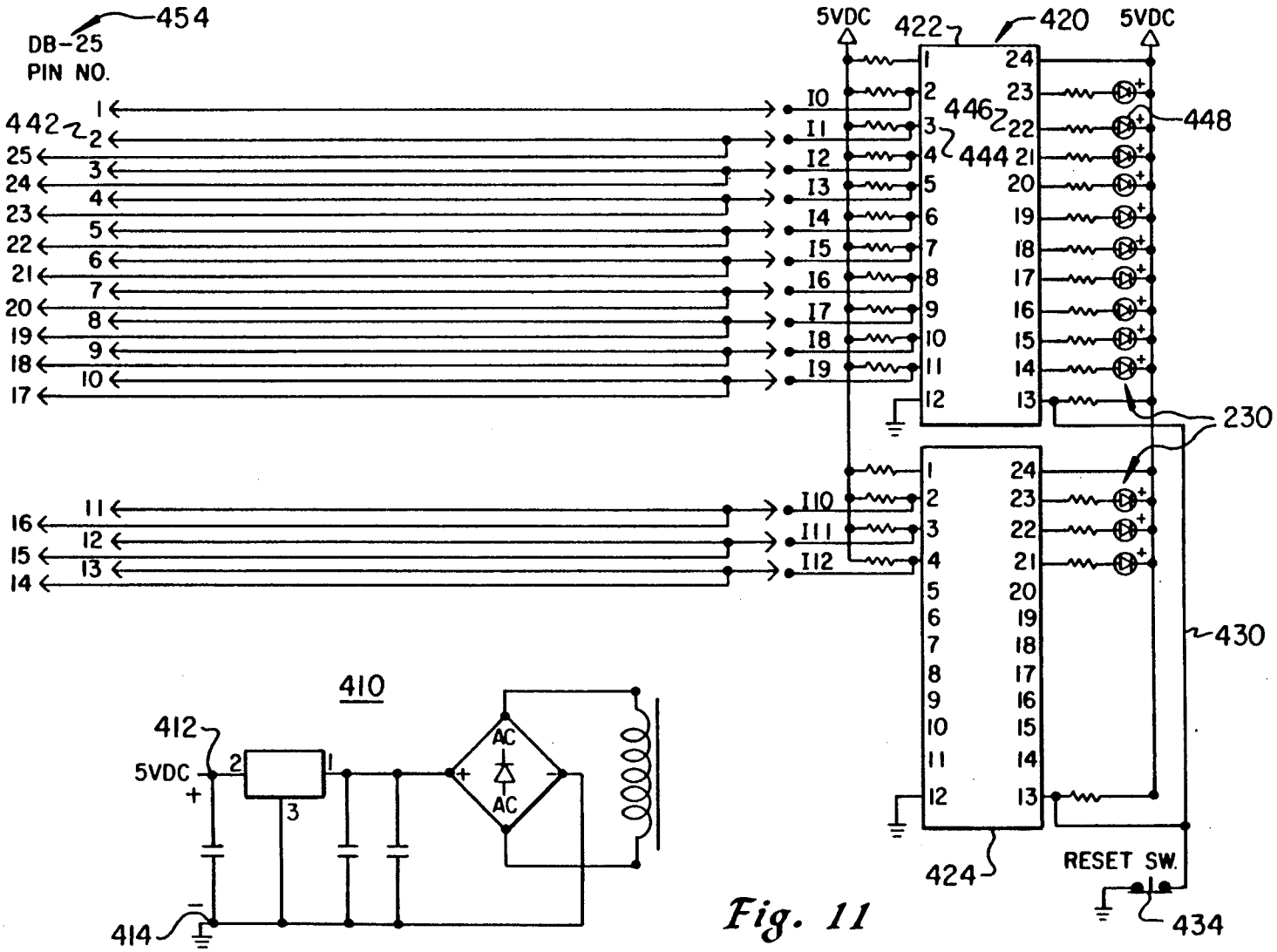
FIG. 11 is a schematic diagram of the discriminator circuit.

In the preferred embodiment of the present invention the discriminator 400 is powered by a DC power supply 410 shown in FIG. 11. The DC power supply 410 provides 5 volts DC available between the positive terminal 412 and the negative, or common, terminal 414. The design of a suitable power supply is well known in the art and will not be further described beyond the representation 410 shown in FIG. 11. The ground symbol shown in FIG. 11 refers to the common terminal of the power supply 410 which, in the case of the preferred embodiment, is the negative terminal 414.

FIG. 11 also shows the logic circuit 420 as well as the individual light emitting diodes (LEDs) 232 of the indicator assembly 200, the discriminator connector 454 of channel A, 570, and the reset cable 430 and reset switch 434 all of which are elements previously described. The logic circuit 420 in the preferred embodiment is comprised of a first field-programmable logic array (PLA-1) 422 and a second field-programmable logic array (PLA-2) 424. PLA-1, 422, and PLA-2, 424, are identical "two-level logic elements consisting of 42 AND gates and 10 OR gates with fusible link connections for programming I/O polarity and direction" as described in the data sheet for the type number PLS173 supplied by Signetics Corporation. Numerous other implementations of the logic circuit 420 are possible, the circuit shown in FIG. 11 being a representation adaptable by persons skilled in the art.

In the preferred embodiment, PLA-1, 422, processes ten separate input signals while PLA-2, 424, processes three separate input signals. The devices are configured according to a predetermined schedule to cause a designated output terminal to be in a logic LOW state whenever a corresponding specified input terminal is caused to be in a logic LOW state because on of a plurality of wires 622 selected at random was grounded at the grounding post 140. The predetermined schedule is derived from the interconnection pattern of the terminals of the two connectors at the ends of the cable 600 to be completed using the present invention.

Continuing the description of the logic circuit 420 shown in FIG. 11, the designated output terminal thus caused to be in a logic LOW state thereupon places the corresponding LED, one of the array 230 in FIG. 11, in an "ON" condition. For example, referring to both FIGS. 6 and 11, one of a plurality of wires 622 is selected, which happens in the case of channel A to be connected to discriminator connector 454, pin number 2, 442, is touched to ground at grounding post 140, thus causing input pin 3, 444, of PLA-1, 422, to assume a logic LOW state, which in turn causes pin 22, 446, to also assume a logic LOW state followed thereupon by the illumination of LED 448. Finally, when the next wire is selected at random and the LED corresponding to its assigned terminal is illuminated, the previously illuminated LED is extinguished. Thus if a short circuit exists between the previously selected wire and another wire or another path to ground the previous LED will remain illuminated.

EJECTION INTERFACE

Figure 4:
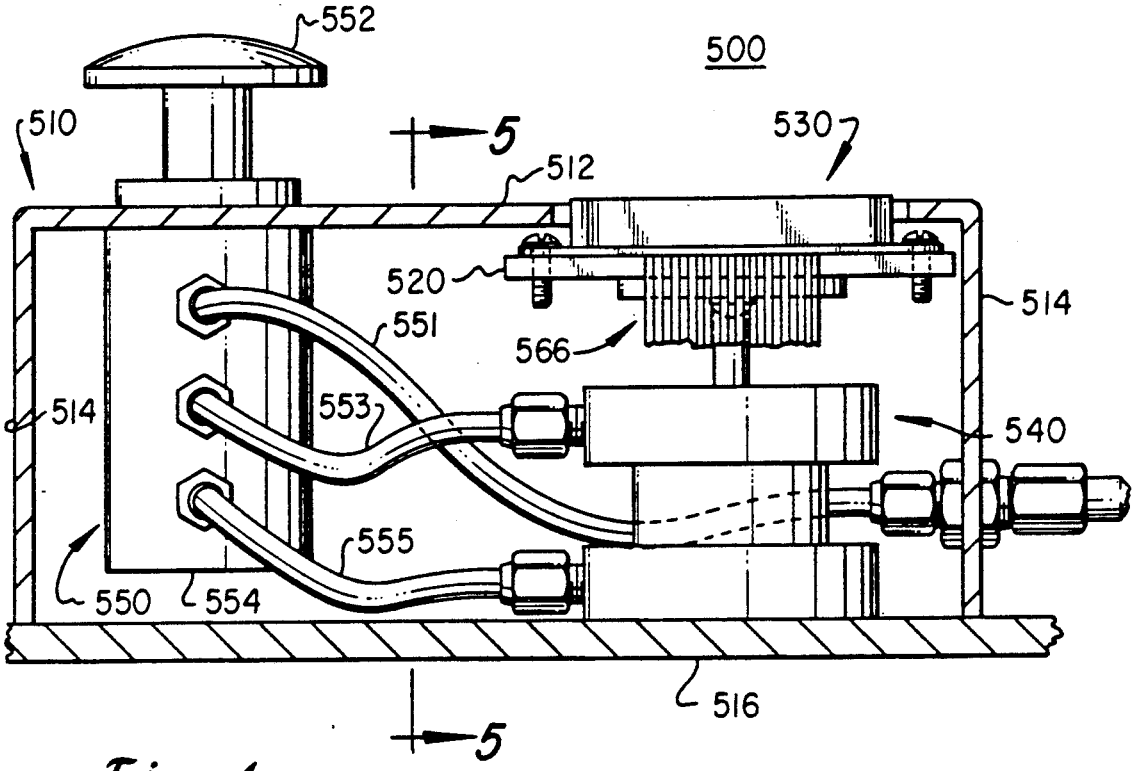
FIG. 4 is a longitudinal sectional view of the ejector unit.
Figure 5:
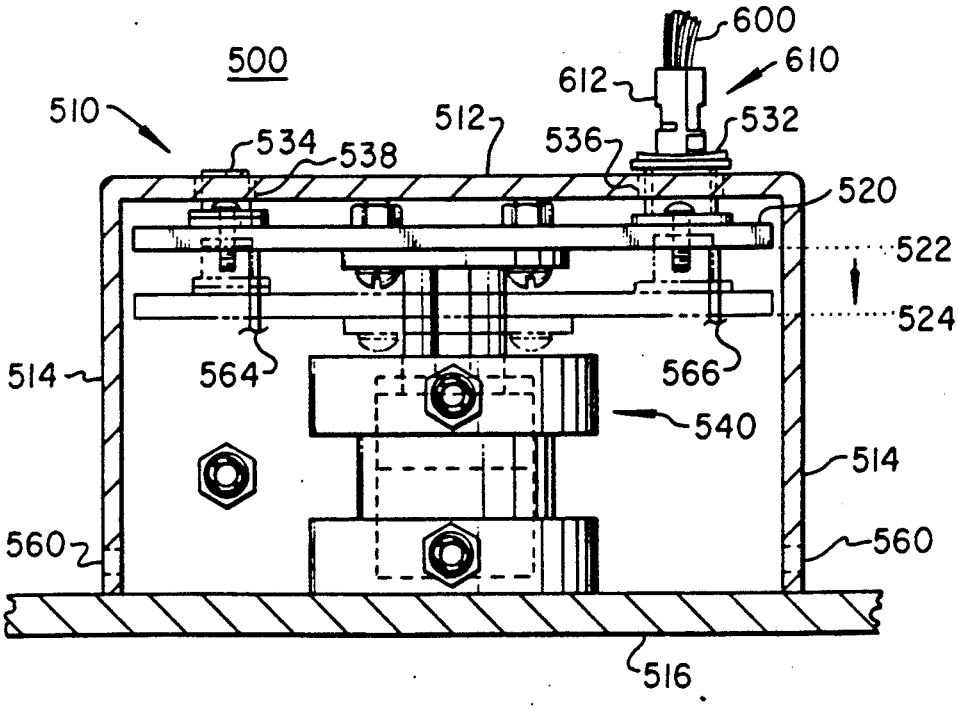
FIG. 5 is a cross-section view taken along the line and in the direction of the arrows 5—5 of the ejector unit of FIG. 4.

The cross-section views of FIGS. 4 and 5 show the general construction and functional parts of the ejection interface 500. The ejection interface 500 interconnects the previously terminated first end 610 of the workpiece cable 600 to be terminated to the input of the discriminator 500 via channel A, 570, or channel B, 572. The connection of the connector 612 of the first end 610 of the cable to be terminated 600 to the mating ejector connector 532, in the case of channel A being used, is performed by other means.

The removal of the connector 612 from the channel A, 570, ejector connector 532 is accomplished by pressing knob 552 which causes pneumatic switch 554 to control the flow of compressed air to and from the pneumatic activator 550 over air supply 551 and first air control valve 553 and second air control line 555. The control of compressed air described above causes the lever 542 to retract into the pneumatic retractor 540. Since the retracting plate 520 is attached to lever 542 retracting plate 520 is withdrawn away from the undersurface of top member 512 and further, since the ejector connector 532 is mounted upon retracting plate 520, and further since the retraction opening 536 in top member 512 is large enough to permin ejector connector 532 to pass through but not the connector 612 the latter is thereby unplugged from the former.

This pneumatically assisted release of the first terminated end 610 of the cable 600 in large part reduces operator fatigue and possible damage to the connectors 612 and 532. The retraction of the ejector connector 532 occurs as retracting plate 520 moves from released position 522 to retracted position 524 as shown in FIG. 5.

The ejector interface 500 components are mounted to a frame 510 which includes upper member 512, side members 514 and base member 516. Frame 510 in the preferred embodiment fully encloses the space in which the pneumatic components 540 and 550, and retracting plate 520 are located for reasons of operator safety and preventing the intrusion of dust into the mechanism. The ejector cables 564 and 566 exit from the frame 510 through an ejector cable port 560 in the longest two of the side members 514 as shown in FIG. 5. The ejector cables 564 and 566 are not shown passing through the ports 560 in FIGS. 4 and 5 for reasons of clarity.

ADAPTERS FOR ENHANCEMENT

There are many possible variations of the preferred embodiment to adapt and improve the usefulness and productivity of the present invention. One modification includes a final test adapter for performing the final testing of the completed cable before removing it from the discrete wire discriminator. The final test adapter, equipped with a TEST control, is connected to an input of suitable logic circuitry (in turn connected to an indicator array) through an ejection interface similar to the one into which the randomly terminated first end 610 of the cable is plugged into. Upon operating the TEST control, the indicator array, which may be the same one used in identifying terminals during the discrimination operation earlier described, also indicates the result of the final test.

A second modification includes an expansion adapter to the ejection interface to permit the interconnection of cables equipped with randomly terminated first connectors other than matable with the ejection connectors of channels A and B as previously described. The expansion adapter may be used in conjunction with interchangeable lower fixture and upper fixture components.

OPERATION OF PREFERRED EMBODIMENT

The discrete wire discriminator having now been fully described structurally, its use in a typical manufacturing situation will now be described. The need for a discrete wire discriminator arises when terminating the second end of a cable comprised of a plurality of identical, unmarked, insulated wires and it is necessary to match a wire which has been randomly terminated at the first end at the second end of the cable with the correct terminal of the connector to be installed upon the second end of the cable.

To begin, the reader is referred to FIG. 5 where the randomly terminated connector 612 at the first end 610 of the cable 600 is connected to a mating ejector connector 532 at the ejection interface 500 and, turning to FIG. 6, the unterminated second end 620 is placed in position in the lower fixture 110 where it is clamped by the cable retainer 120. The operator then places the connector 630 to be installed on the second end 620 of the cable 600 in the lower fixture 110. The connector 630 is installed in the lower fixture 110 with the terminals 632 facing the end of the cable 600 and secured by placing the connector retainer 120 over the guide pins 122 and downward over the connector 630. The connector retainer 120 is then locked into position by the spring clips 124. Note that the location of the ejector connector 532, the cable retainer 130 and the connector reatainer 120 are also shown in FIG. 2. With the cable 600 and the connector 630 now in position in the apparatus, the procedure for selecting, discriminating and terminating may now be related.

Turning now to FIG. 7, the input signal to the discriminator 400 is provided when the operator randomly selects a wire 624 of a plurality of wires 622 of the second end 620 of the cable 600 and touches the free end 626 to the grounding post 140 or dips the free end 626 in the conductive liquid. The purpose of the conductive liquid 148 in the well 146 in the upper end 142 of the grounding post 140 is to ensure a reliable connection to ground in case the conductors of the selected one of a plurality of wires 622 are slightly withdrawn within the insulation on the wire. Ordinary tap water is a suitable conductive liquid as long as it has not been distilled or otherwise purified to remove minerals or other impurities.

When the ground connection is thus made, an LED 234 under the parallel slot 154 in the wire sorter 150 corresponding to the correct terminal is illuminated by the discriminator 400 as shown by the darkened spot at LED 234 in the raised perspective top view of the indicator assembly 210. Then the operator places the wire 624 in the indicator parallel slot 154 where it is retained by the wire sorter 150. Each remaining one of a plurality of wires 622 in turn is selected and its corresponding terminal discriminated by repeating the above process. In this procedure the selected wire is also placed in the slots of the connector retainer 120 which are correspondingly colinear with the parallel slots 152 in the wire sorter 150 as shown in FIG. 8.

Figure 9:
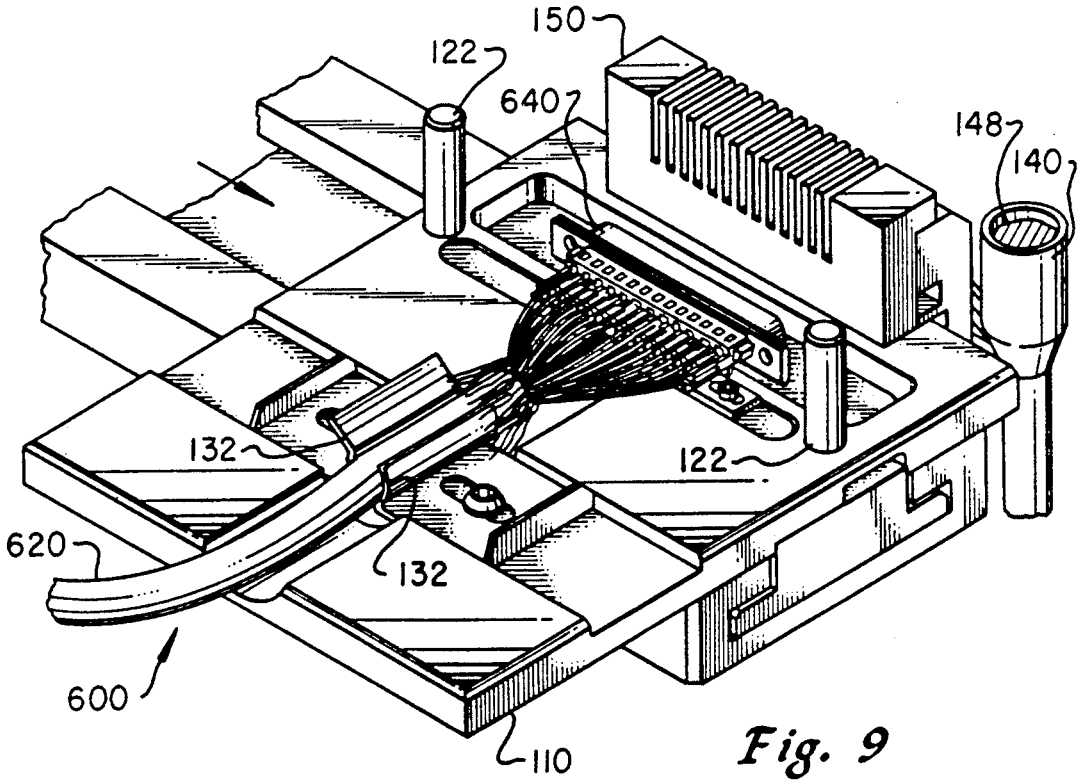
FIG. 9 is a similar perspective view of FIG. 8 after termination of the wires to the connector and prior to removal of the terminated cable from the apparatus.

When all of the plurality of wires 622 are in place in the wire sorter 150 as shown in FIG. 8, the lower fixture 110 is slid toward the rear of the arbor press 102 as indicated by the arrow of FIG. 8 whereupon a trip switch 114 (shown in phantom view in FIG. 1) activates the pneumatically operated ram causing the upper fixture 310 to bring the upper shear blade 314 and the upper terminator 312 into contact with sufficient force and displacement upon the plurality of wires 622 and connector terminals 632 to trim the plurality of wires 622 and secure them to the terminals by the method of insulation displacement well known in the art. When the ram subsequently retracts, and the lower fixture 110 is slid forward as shown in FIG. 9, the terminated wire ends are removed and the terminated cable 600 released from the lower fixture 110. To release the first end 610 of the cable 600 from the ejection interface 500 the operator presses the ejection knob 552 which disconnects the ejection interface 500 from the cable 600 by holding the connector 612 on the first end 610 of the cable 600 in a fixed position against the frame 510 of the ejection interface 500 while retracting the ejector connector 532 through the retraction opening 536.

TESTING

Attention is now directed to the point during the discrimination procedure when a light emitting diode 232 is illuminated to indicate into which parallel slot 152 and the corresponding connector terminal 632 the selected wire 622 is to be placed. The illuminated LED thereby also indicates the electrical continuity of both the selected wire and its termination to the connector 532 previously terminated to the first end 610 of the cable 600. The failure of the LED to illuminate at this point indicates an open circuit in either the wire or the first connector termination. An open indication may also mean the grounding post is not functioning correctly.

During the discrimination procedure, once an LED is illuminated, it remains illuminated until the reset switch 434 is activated by pressing the reset activator 432 (as shown in FIG. 1 and 2), normally after the discrimination procedure has been completed. Of course, the discriminator 400 may be reset at any time the operator wishes. For example, the pesence of a short circuit between wires or to ground may b4e tested by resetting tyhe discriminator and observing the indicator assembly 200 for unextinguished elements or for illumination of multiple elements when a single wire is selected.

Continuity or short circuit testing of the completed cable assembly, particularly the secondly terminated end, must be accomplished with a procedure after the second end is terminated using the discrete wire discriminator unless the preferred embodiment is equipped with a final test adapter as discussed earlier. However, it will be recognized that even in standard form the present invention inherently tests the workpiece cable assembly and thus sifnificantly reduces labor costs. Operator errors are also reduced because placing the wires in an illuminated wire sorter position is much more reliable than determining the color or other marking of a wire and placing it in the lower fixture by memory or a chart. In addition, if faulty shorts or opens are found during the discrimination procedure, the workpiece cable assembly may be discarded and production resumed on fresh materials. Thus, production operations on defective materials is ceased at the earliest possible moment and no time is wasted on them.

While the particular embodiments of the present invention have been described herein, it will be understood that numerous modifications may be made thereto without departing from the spirit thereof, and the appended claims are contemplated to cover any such modifications as fall within the spirit and scope of this invention.

What is claimed is:

1. A method for terminating wires of a cable en masse, the cable having a first end at which the wires of the cable are terminated by a first connector, the first connector having first terminals, the cable wires at the second end of the cable being free, comprising the following steps:

coupling the first connector to a discriminator;

placing the second end of the cable at a wire connector assembly, the wire connector assembly including a second connector, having second terminals, for connection to the free ends of the corresponding cable wires, a common terminal electrically coupled to the first terminals through the discriminator and a series of visual indicators electrically coupled to the first terminals and physically aligned with corresponding ones of the second terminals;

selecting a said free end and electrically contacting the said free end to the common terminal by placing said free end in a well containing a conductive liquid so to actuate the visual indicator associated with said selected free end;

positioning said selected free end at the second terminal which is aligned with the actuated visual indicator;

repeating the selecting and positioning steps for each of said free ends; and thereafter simultaneously securing the free ends to the second connector.

2. The method of claim 1 wherein the positioning step includes the step of placing said selected free end within a first retainer aligned with the actuated visual indicator.

3. The method of claim 2 wherein the positioning step includes the step of placing said selected free end within a second retainer aligned with the first retainer and with said second terminal which is aligned with said actuated visual indicator.

4. The method of claim 1 wherein the securing step is carried out using a crimping press.

5. The method of claim 1 wherein is further included a testing step.

6. The method of claim 5 wherein said testing step is carried out by said discriminator.

* * * * *